US009243493B2

(12) United States Patent
Hsu et al.

(10) Patent No.: US 9,243,493 B2
(45) Date of Patent: Jan. 26, 2016

(54) FLUID DENSITY FROM DOWNHOLE OPTICAL MEASUREMENTS

(71) Applicant: Schlumberger Technology Corporation, Sugar Land, TX (US)

(72) Inventors: Kai Hsu, Sugar Land, TX (US); Kentaro Indo, Sugar Land, TX (US); Oliver C. Mullins, Ridgefield, CT (US); Peter S. Hegeman, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 236 days.

(21) Appl. No.: 13/886,605

(22) Filed: May 3, 2013

(65) Prior Publication Data

US 2013/0239664 A1 Sep. 19, 2013

Related U.S. Application Data

(62) Division of application No. 12/543,017, filed on Aug. 18, 2009, now Pat. No. 8,434,356.

(51) Int. Cl.
*E21B 47/10* (2012.01)
*E21B 49/08* (2006.01)

(52) U.S. Cl.
CPC ..... *E21B 49/087* (2013.01); *E21B 47/102* (2013.01); *E21B 49/08* (2013.01); *E21B 2049/085* (2013.01)

(58) Field of Classification Search
CPC ..... E21B 49/08
USPC ..... 73/152.18, 152.22, 152.24, 152.27, 73/152.28, 152.52, 1.57, 1.66, 1.67, 1.69, 73/1.71; 166/250.01, 250.07, 254.2; 175/40, 41, 48, 50
See application file for complete search history.

(56) References Cited

U.S. PATENT DOCUMENTS 2,550,844 A 5/1951 Meiller et al.
2,966,055 A 12/1960 Tracht et al.

(Continued)

FOREIGN PATENT DOCUMENTS

EP 1804048 A1 7/2007
EP 2012117 A1 1/2009

(Continued)

OTHER PUBLICATIONS

Canfield, et al., "Electromagnetic Gas Pump for Low Temperature Service", Review of Scientific Instruments, vol. 34 (12), 1963, pp. 1431-1433.

(Continued)

*Primary Examiner* — Hezron E Williams
*Assistant Examiner* — Hoang Nguyen
(74) *Attorney, Agent, or Firm* — Kenneth L. Kincaid

(57) ABSTRACT

A system and method for determining at least one fluid characteristic of a downhole fluid sample using a downhole tool are provided. In one example, the method includes performing a calibration process that correlates optical and density sensor measurements of a fluid sample in a downhole tool at a plurality of pressures. The calibration process is performed while the fluid sample is not being agitated. At least one unknown value of a density calculation is determined based on the correlated optical sensor measurements and density sensor measurements. A second optical sensor measurement of the fluid sample is obtained while the fluid sample is being agitated. A density of the fluid sample is calculated based on the second optical sensor measurement and the at least one unknown value.

4 Claims, 10 Drawing Sheets

(56) References Cited

U.S. PATENT DOCUMENTS

| | | | | |
|---|---|---|---|---|
| 3,252,131 | A | 5/1966 | Vogel | |
| 3,780,575 | A | 12/1973 | Urbanosky | |
| 3,811,321 | A | 5/1974 | Urbanosky | |
| 3,813,936 | A | 6/1974 | Urbanosky et al. | |
| 3,859,851 | A | 1/1975 | Urbanosky | |
| 3,954,006 | A | 5/1976 | Anderson et al. | |
| 4,782,695 | A | 11/1988 | Glotin et al. | |
| 4,833,915 | A | 5/1989 | Radd et al. | |
| 4,860,581 | A | 8/1989 | Zimmerman et al. | |
| 4,936,139 | A | 6/1990 | Zimmerman et al. | |
| 4,994,671 | A | 2/1991 | Safinya et al. | |
| 5,167,149 | A | 12/1992 | Mullins et al. | |
| 5,201,220 | A | 4/1993 | Mullins et al. | |
| 5,226,310 | A | 7/1993 | Steiger | |
| 5,233,866 | A | 8/1993 | Desbrandes | |
| 5,247,830 | A | 9/1993 | Goode | |
| 5,266,800 | A | 11/1993 | Mullins | |
| 5,329,811 | A | 7/1994 | Schultz et al. | |
| 5,331,156 | A | 7/1994 | Hines et al. | |
| 5,473,939 | A | 12/1995 | Leder et al. | |
| 5,549,159 | A | 8/1996 | Shwe et al. | |
| 5,622,223 | A | 4/1997 | Vasquez | |
| 5,635,631 | A | 6/1997 | Yesudas et al. | |
| 5,708,204 | A | 1/1998 | Kasap | |
| 5,741,962 | A | 4/1998 | Birchak et al. | |
| 5,837,893 | A | 11/1998 | Chu | |
| 5,859,430 | A | 1/1999 | Mullins et al. | |
| 5,934,374 | A | 8/1999 | Hrametz | |
| 5,939,717 | A | 8/1999 | Mullins | |
| 6,102,673 | A | 8/2000 | Mott et al. | |
| 6,128,949 | A | 10/2000 | Kleinberg | |
| 6,148,912 | A | 11/2000 | Ward | |
| 6,176,323 | B1 | 1/2001 | Weirich et al. | |
| 6,178,815 | B1 * | 1/2001 | Felling | E21B 49/10 166/250.07 |
| 6,189,612 | B1 | 2/2001 | Ward | |
| 6,230,824 | B1 | 5/2001 | Peterman et al. | |
| 6,274,865 | B1 | 8/2001 | Schroer et al. | |
| 6,296,056 | B1 | 10/2001 | Ward | |
| 6,301,959 | B1 | 10/2001 | Hrametz et al. | |
| 6,325,159 | B1 | 12/2001 | Peterman et al. | |
| 6,334,489 | B1 | 1/2002 | Shwe et al. | |
| 6,343,507 | B1 * | 2/2002 | Felling | G01N 33/2823 166/254.2 |
| 6,467,544 | B1 | 10/2002 | Brown et al. | |
| 6,474,152 | B1 | 11/2002 | Mullins et al. | |
| 6,476,384 | B1 | 11/2002 | Mullins et al. | |
| 6,522,974 | B2 | 2/2003 | Sitton | |
| 6,580,317 | B1 | 6/2003 | Oppelt | |
| 6,585,045 | B2 | 7/2003 | Lee et al. | |
| 6,609,568 | B2 | 8/2003 | Krueger et al. | |
| 6,640,625 | B1 | 11/2003 | Goodwin | |
| 6,659,177 | B2 | 12/2003 | Bolze et al. | |
| 6,688,176 | B2 | 2/2004 | Storm, Jr. et al. | |
| 6,688,390 | B2 | 2/2004 | Bolze et al. | |
| 6,719,049 | B2 | 4/2004 | Sherwood et al. | |
| 6,755,086 | B2 | 6/2004 | Salamitou et al. | |
| 6,758,090 | B2 | 7/2004 | Bostrom et al. | |
| 6,768,105 | B2 | 7/2004 | Mullins et al. | |
| 6,775,996 | B2 | 8/2004 | Cowans | |
| 6,842,700 | B2 | 1/2005 | Poe | |
| 6,850,317 | B2 | 2/2005 | Mullins et al. | |
| 6,854,341 | B2 | 2/2005 | Oddie et al. | |
| 6,898,963 | B2 | 5/2005 | Irani | |
| 6,964,301 | B2 | 11/2005 | Hill et al. | |
| 7,036,579 | B2 | 5/2006 | Follini et al. | |
| 7,100,689 | B2 | 9/2006 | Williams et al. | |
| 7,114,562 | B2 | 10/2006 | Fisseler et al. | |
| 7,178,591 | B2 | 2/2007 | Del Campo et al. | |
| 7,317,989 | B2 | 1/2008 | DiFoggio et al. | |
| 7,346,460 | B2 | 3/2008 | DiFoggio et al. | |
| 7,347,262 | B2 | 3/2008 | Tarvin et al. | |
| 7,458,252 | B2 | 12/2008 | Freemark et al. | |
| 7,461,547 | B2 | 12/2008 | Terabayashi et al. | |
| 7,484,563 | B2 | 2/2009 | Zazovsky et al. | |
| 7,523,640 | B2 | 4/2009 | DiFoggio et al. | |
| 7,874,199 | B2 | 1/2011 | Chaudoreille et al. | |
| 7,913,556 | B2 | 3/2011 | Hsu et al. | |
| 8,047,286 | B2 | 11/2011 | Zazovsky et al. | |
| 8,060,311 | B2 * | 11/2011 | Ramshaw | E21B 44/00 175/17 |
| 8,109,155 | B2 | 2/2012 | Otsuka | |
| 8,146,655 | B2 | 4/2012 | Indo et al. | |
| 8,156,800 | B2 | 4/2012 | Terabayashi et al. | |
| 2002/0112854 | A1 | 8/2002 | Krueger et al. | |
| 2002/0194906 | A1 | 12/2002 | Goodwin et al. | |
| 2002/0194907 | A1 | 12/2002 | Bostrom et al. | |
| 2003/0033866 | A1 | 2/2003 | Diakonov et al. | |
| 2003/0209066 | A1 | 11/2003 | Goodwin | |
| 2004/0000433 | A1 | 1/2004 | Hill et al. | |
| 2004/0000636 | A1 | 1/2004 | Mullins et al. | |
| 2004/0045706 | A1 | 3/2004 | Pop et al. | |
| 2004/0123645 | A1 | 7/2004 | Storm, Jr. et al. | |
| 2006/0070426 | A1 | 4/2006 | Pelletier | |
| 2007/0035736 | A1 | 2/2007 | Vannuffelen et al. | |
| 2008/0156088 | A1 | 7/2008 | Hsu et al. | |
| 2008/0156487 | A1 | 7/2008 | Zazovsky et al. | |
| 2009/0138216 | A1 | 5/2009 | Africk | |
| 2009/0308600 | A1 | 12/2009 | Hsu et al. | |
| 2009/0316528 | A1 * | 12/2009 | Ramshaw | E21B 44/00 367/83 |
| 2010/0192684 | A1 * | 8/2010 | Wu | E21B 49/082 73/152.55 |
| 2010/0212889 | A1 | 8/2010 | Otsuka | |
| 2011/0042070 | A1 | 2/2011 | Hsu et al. | |
| 2011/0061439 | A1 * | 3/2011 | Dong | E21B 49/08 73/1.03 |
| 2013/0071934 | A1 * | 3/2013 | Indo | G01N 21/80 436/28 |

FOREIGN PATENT DOCUMENTS

| | | | |
|---|---|---|---|
| GB | 2362960 | A | 12/2001 |
| GB | 2397382 | A | 7/2004 |
| WO | 0231476 | A3 | 4/2002 |
| WO | 2006039513 | A1 | 4/2006 |
| WO | 2006117604 | A1 | 11/2006 |

OTHER PUBLICATIONS

Dake, et al., "Fundamentals of Reservoir Engineering", Elsevier Scientific Publishing Company, 1978, pp. 1-43.

Duncan, et al., "A Double-Acting All-Glass Gas Circulating Pump", Journal of Scientific Instruments, vol. 44 (5), 1967, p. 388.

Ellis, et al., "A Demountable Glass Circulating Pump", Journal of Scientific Instruments, vol. 39 (5), 1962, pp. 234-235.

Erdman, et al., "Simple Gas Circulation Pump", Review of Scientific Instruments, vol. 35 (2), 1964, p. 241.

Joshi, et al., "Asphaltene Precipitation from Live Crude Oil", Energy Fuels, vol. 15 (4), 2001, pp. 979-986.

Kallo, et al., "Circulating Pump and Flowmeter for Kinetic Reaction Apparatus", Journal of Scientific Instruments, vol. 41 (5), 1964, pp. 338-340.

Karstad, et al., "Density Behavior of Drilling Fluids During High Pressure High Temperature Drilling Operations", SPE 47806—IADC/SPE Asia Pacific Drilling Technology, Jakarta, Indonesia, Sep. 7-9, 1998, pp. 1-11.

Lee, et al., "Using PV Tests for Bubble Point Pressures and Quality Control", SPWLA 44th Annual Logging Symposium, Jun. 22-25, 2003, pp. 1-7.

Lloyd, et al., "EPR Cavity for Oriented Single Crystals in Sealed Tubes", Review of Scientific Instruments, vol. 40 (3), 1969, pp. 514-515.

McCullagh, et al., "Generalized Linear Model", 2nd Edition, Chapman and Hall, 1989.

Mohamed, et al., "Simple High-Speed Circulating Pump for Gases", Rev. Sci. Instrum., vol. 60 (7), Jul. 1989, pp. 1349-1350.

Mullins, et al., "Effect of high pressure on the optical detection of gas by index-of-refraction methods", Applied Optics, vol. 33 (34), Dec. 1994, pp. 7963-7970.

(56) References Cited

OTHER PUBLICATIONS

Mullins, et al., "Linearity of Near-infrared Spectra of Alkanes", Applied Spectroscopy, vol. 54 (4), 2000, pp. 624-629.
Ostrander, W.J., "Plane-wave reflection coefficients for gas sands at nonnormal angles of incidence", Geophysics, vol. 49 (10), Oct. 1984, pp. 1637-1648.
Palmer, et al., "Advances in Fluid Identification Methods Using a High Resolution Densitometer in a Saudi Aramco Field", SPWLA 49th Annual Logging Symposium, May 25-28, 2008, pp. 1-12.
Ruiz-Morales, et al., "Electronic Absorption Edge of Crude Oils and Asphaltenes Analyzed by Molecular Orbital Calculations with Optical Spectroscopy", Energy & Fuels, vol. 21, 2007, pp. 944-952.
Sterner, et al., "Electromagnetic Pump for Circulating Gases at Low Flow Rates", Review of Scientific Instruments, vol. 31 (10), Oct. 1960, pp. 1159-1160.
Walker, et al., "Circulation pump for high purity gases at high pressures and a novel linear motor positioning system", Review of Scientific Instruments, vol. 67 (2), Feb. 1996, pp. 564-578.
White, J.E., "Underground Sound: Application of Seismic Waves", Methods in Geochemistry and Geophysics, Elsevier Science Ltd., 1983, pp. 58-60.

* cited by examiner

FLUID DENSITY FROM DOWNHOLE OPTICAL MEASUREMENTS

CROSS-REFERENCE TO RELATED APPLICATIONS

This application is a divisional of U.S. patent application Ser. No. 12/543,017, filed Aug. 18, 2009, now U.S. Pat. No. 8,434,356, and is related to and incorporates herein by reference in their entirety the following patent applications and patents: U.S. patent application Ser. No. 12/543,042, filed on Aug. 28, 2009, now U.S. Pat. No. 8,434,357, and entitled "Clean Fluid Sample for Downhole Measurements"; U.S. patent application Ser. No. 12/137,058, filed Jun. 11, 2008, now U.S. Pat. No. 7,913,556, and entitled "Methods and Apparatus to Determine the Compressibility of a Fluid"; and U.S. Pat. Nos. 6,474,152; 7,458,252; and 7,461,547.

BACKGROUND

Reservoir fluid analysis is a key factor for understanding and optimizing reservoir management. In most hydrocarbon reservoirs, fluid composition varies vertically and laterally in a formation. Fluids characteristics, including density and compressibility, may exhibit gradual changes caused by gravity or biodegradation, or they may exhibit more abrupt changes due to structural or stratigraphic compartmentalization. Traditionally, fluid information is obtained by capturing samples, either at downhole or surface conditions, and then measuring various properties of the samples in a surface laboratory. In recent years, downhole fluid analysis (DFA) techniques, such as those using a Modular Formation Dynamics Tester (MDT) tool, have been used to provide downhole fluid property information.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
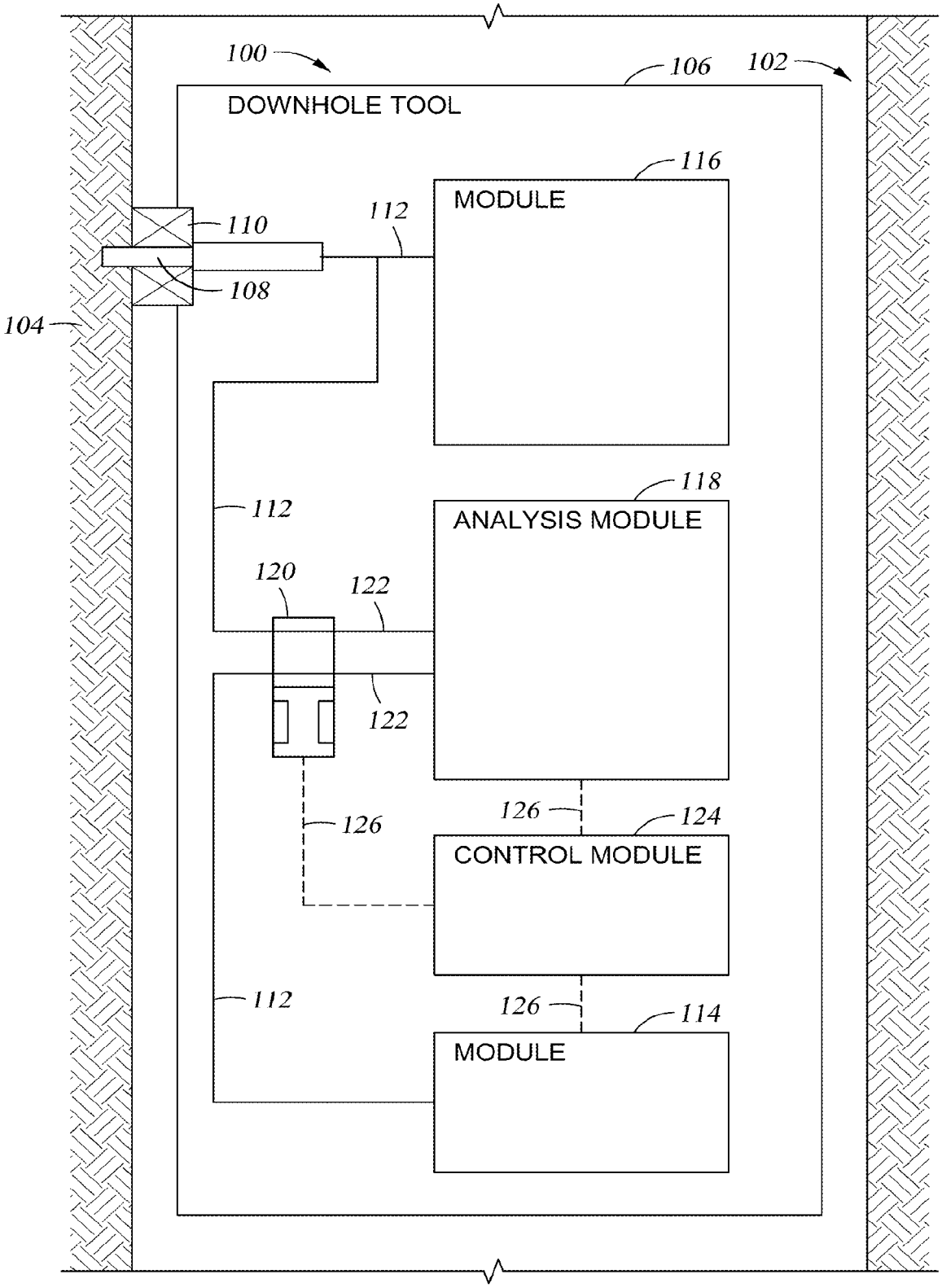
FIG. 1 is a schematic view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure describes embodiments illustrating the use of downhole fluid analysis to measure the density and compressibility of a downhole fluid in reservoir conditions. The disclosure also describes an in-situ calibration procedure that eliminates the uncertainty of measurements that may be caused by conventional tool calibration and other environmental factors. It is understood that the described optical measuring methods and systems may be used alone or in combination with other measurements.

FIG. 1 is a schematic view of a downhole tool 100 according to one or more aspects of the present disclosure. The tool 100 may be used in a borehole 102 formed in a geological formation 104, and may be conveyed by wire-line, drill-pipe, tubing, and/or any other means (not shown).

The tool 100 includes a housing 106 that contains a sampling probe 108 with a seal (e.g., packer) 110 that is used to acquire a fluid sample, such as hydrocarbon, from the formation 104.

The fluid sample enters a main flowline 112 that may be used to transport the sample to other locations within the tool 100, including modules 114 and 116, and an analysis module 118. The modules 114 and 116 may represent many different types of components/systems and may perform many different functions. For example, the module 114 may contain pressure and temperature sensors, while the module 116 may be a pump used to move the sample through the flowline 112. The analysis module 118 may include components configured to perform optical analysis of the sample's fluid density and compressibility, as will be described below in greater detail. One or more valves 120 may be used to control the delivery of the fluid sample from the flowline 112 to the analysis module 118 via one or more circulation flowlines 122. A control module 124 may be in signal communication with the analysis module 118, valve 120, and/or other modules via communication channels 126.

Figure 2A:
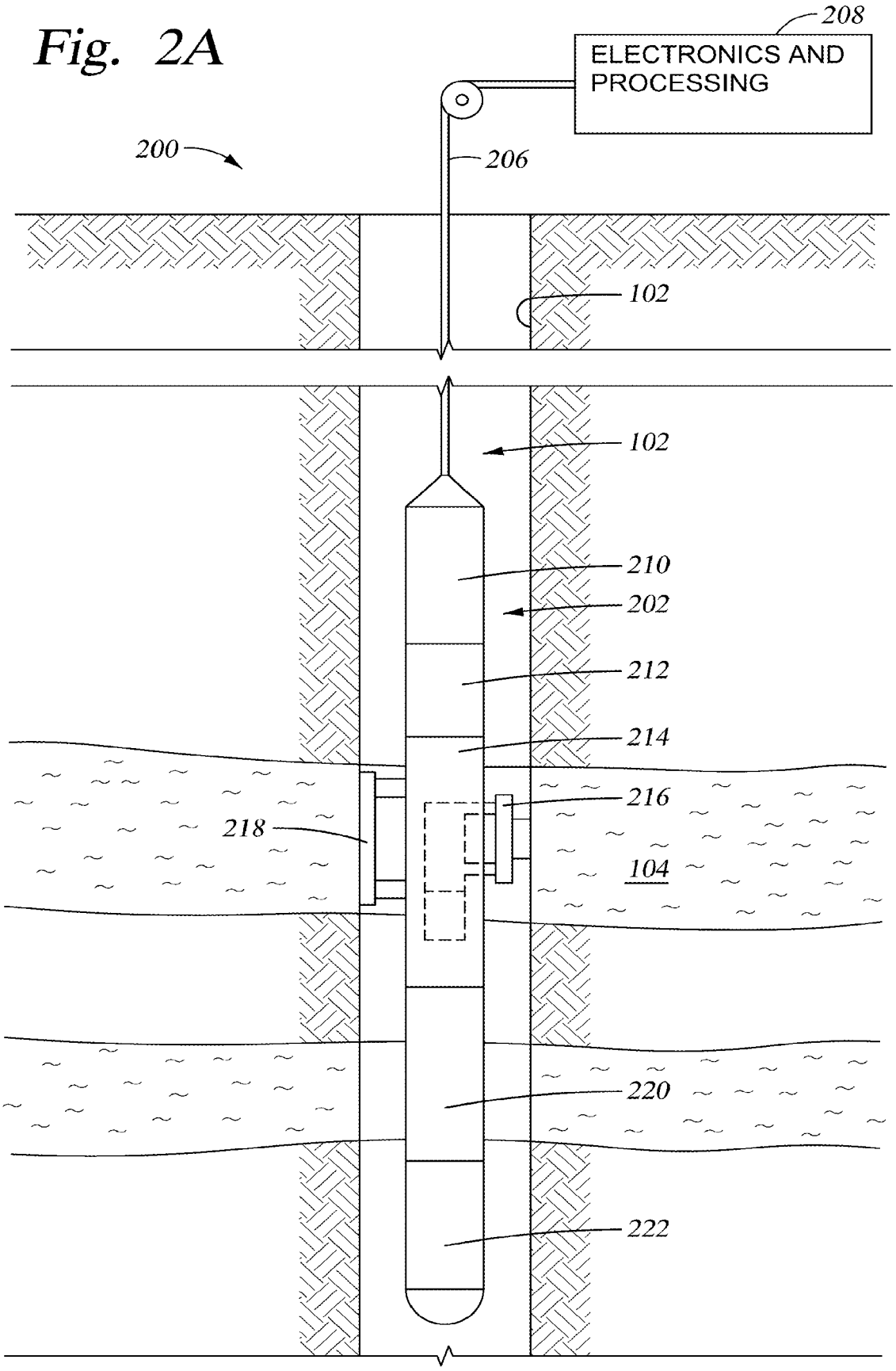
FIG. 2A is a schematic view of apparatus according to one or more aspects of the present disclosure.

FIG. 2A is a schematic view of apparatus according to one or more aspects of the present disclosure, including one embodiment of an environment 200 for a wireline tool 202 in which aspects of the present disclosure may be implemented. The wireline tool 202 may be similar or identical to the downhole tool 100 of FIG. 1. The wireline tool 202 is suspended in a wellbore 102 from the lower end of a multiconductor cable 206 that is spooled on a winch (not shown) at the Earth's surface. At the surface, the cable 206 is communicatively coupled to an electronics and processing system 208. The wireline tool 202 includes an elongated body 210 that includes a formation tester 214 having a selectively extendable probe assembly 216 and a selectively extendable tool anchoring member 218 that are arranged on opposite sides of the elongated body 210. Additional modules 212 (e.g., components described above with respect to FIG. 1) may also be included in the tool 202.

One or more aspects of the probe assembly 216 may be substantially similar to those described above in reference to the embodiments shown in FIG. 1. For example, the extendable probe assembly 216 is configured to selectively seal off or isolate selected portions of the wall of the wellbore 102 to fluidly couple to the adjacent formation 104 and/or to draw fluid samples from the formation 104. The formation fluid may be analyzed and/or expelled into the wellbore through a port (not shown) as described herein and/or it may be sent to one or more fluid collecting modules 220 and 222. In the illustrated example, the electronics and processing system 208 and/or a downhole control system (e.g., the control module 124 of FIG. 1) are configured to control the extendable probe assembly 216 and/or the drawing of a fluid sample from the formation 104.

Figure 2B:
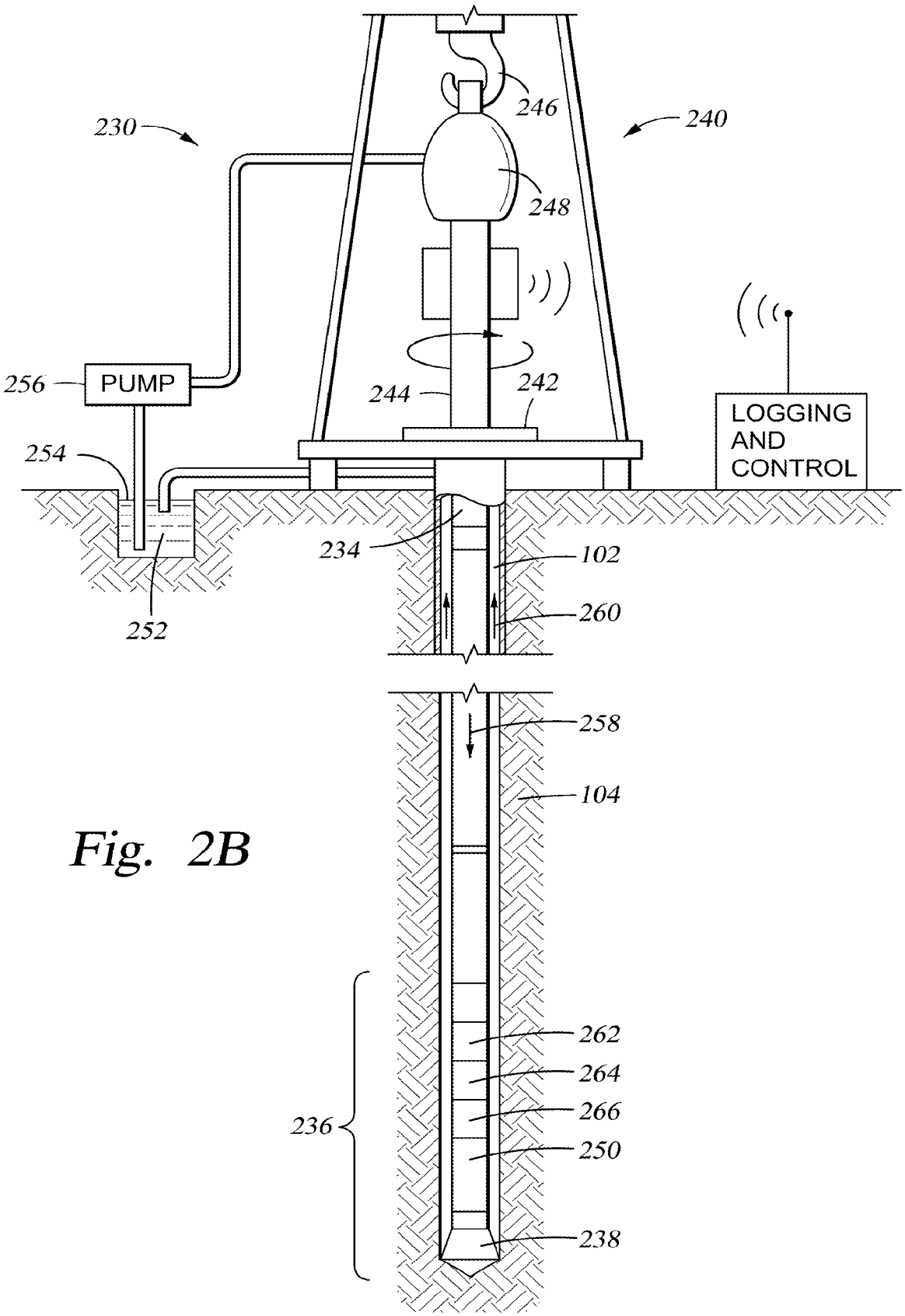
FIG. 2B is a schematic view of apparatus according to one or more aspects of the present disclosure.

FIG. 2B is a schematic view of apparatus according to one or more aspects of the present disclosure, including one embodiment of a wellsite system environment 230 in which aspects of the present disclosure may be implemented. The wellsite can be onshore or offshore. A borehole 102 is formed in one or more subsurface formations by rotary and/or directional drilling.

A drill string 234 is suspended within the borehole 102 and has a bottom hole assembly 236 that includes a drill bit 238 at its lower end. The surface system includes platform and derrick assembly 240 positioned over the borehole 102, the assembly 240 including a rotary table 242, a kelly 244, a hook 246 and a rotary swivel 248. The drill string 234 is rotated by the rotary table 242, energized by means not shown, which engages the kelly 244 at the upper end of the drill string. The drill string 234 is suspended from the hook 246, attached to a traveling block (also not shown), through the kelly 244 and the rotary swivel 248, which permits rotation of the drill string relative to the hook. As is well known, a top drive system could alternatively be used.

The surface system further includes drilling fluid or mud 252 stored in a pit 254 formed at the well site. A pump 256 delivers the drilling fluid 252 to the interior of the drill string 234 via a port in the swivel 248, causing the drilling fluid to flow downwardly through the drill string 234 as indicated by the directional arrow 258. The drilling fluid 252 exits the drill string 234 via ports in the drill bit 238, and then circulates upwardly through the annulus region between the outside of the drill string and the wall of the borehole 102, as indicated by the directional arrows 260. In this well known manner, the drilling fluid 252 lubricates the drill bit 238 and carries formation cuttings up to the surface as it is returned to the pit 254 for recirculation.

The bottom hole assembly 236 may include a logging-while-drilling (LWD) module 262, a measuring-while-drilling (MWD) module 264, a roto-steerable system and motor 250, and drill bit 238. The LWD module 262 may be housed in a special type of drill collar, as is known in the art, and can contain one or more known types of logging tools. It is also understood that more than one LWD and/or MWD module can be employed, e.g., as represented by LWD tool suite 266. (References, throughout, to a module at the position of 262 can alternatively mean a module at the position of 266 as well.) The LWD module 262 (which may be similar or identical to the tool 100 shown in FIG. 1 or may contain components of the tool 100) may include capabilities for measuring, processing, and storing information, as well as for communicating with the surface equipment. In the present embodiment, the LWD module 262 includes a fluid analysis device, such as that described with respect to FIG. 1.

The MWD module 264 may also be housed in a special type of drill collar, as is known in the art, and can contain one or more devices for measuring characteristics of the drill string 234 and drill bit 238. The MWD module 264 further includes an apparatus (not shown) for generating electrical power to the downhole system. This may typically include a mud turbine generator powered by the flow of the drilling fluid, it being understood that other power and/or battery systems may be employed. The MWD module 264 may include one or more of the following types of measuring devices: a weight-on-bit measuring device, a torque measuring device, a vibration measuring device, a shock measuring device, a stick/slip measuring device, a direction measuring device, and an inclination measuring device.

Figure 2C:
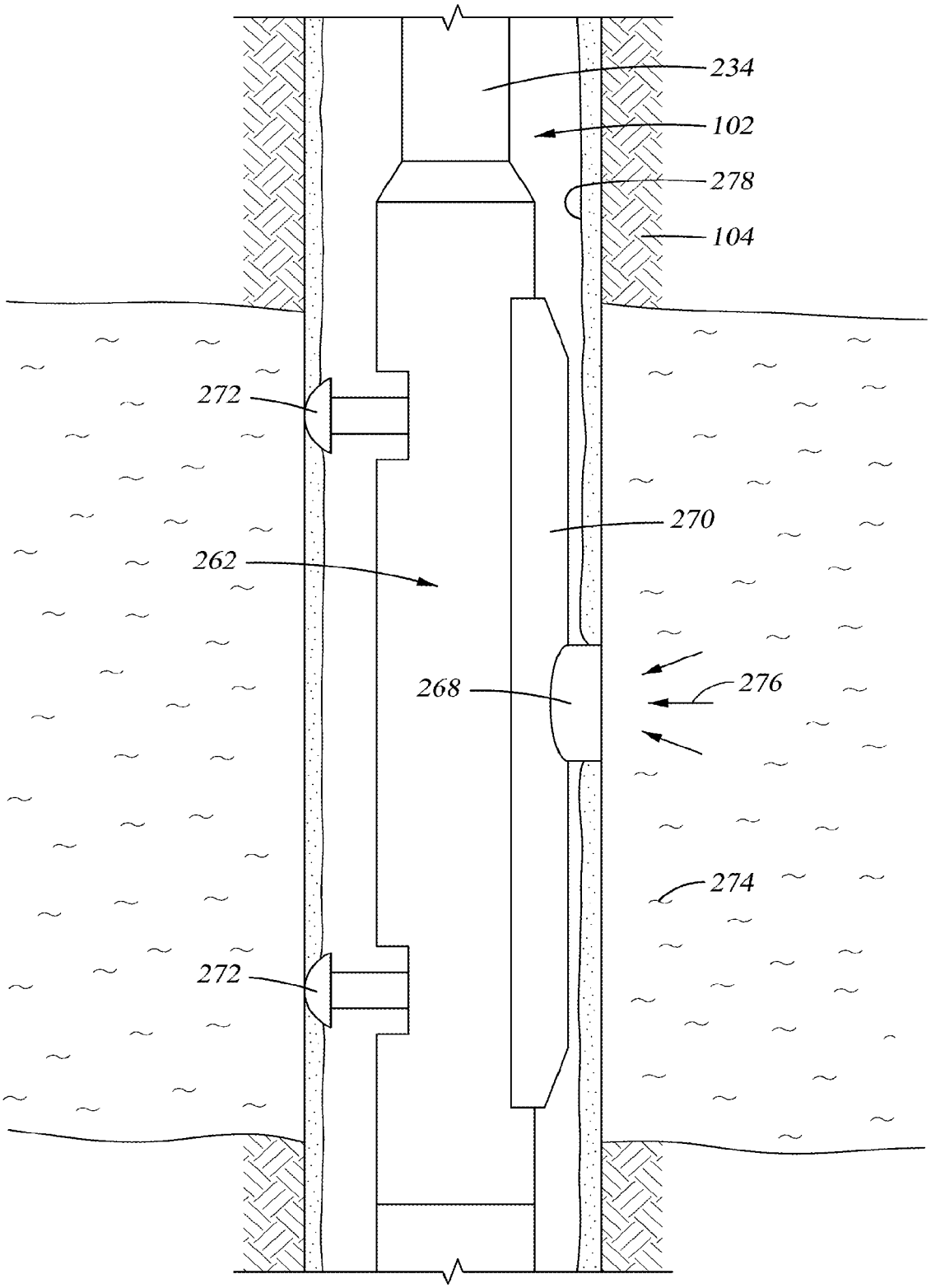
FIG. 2C is a schematic view of apparatus according to one or more aspects of the present disclosure.

FIG. 2C is a simplified diagram of a sampling-while-drilling logging device of a type described in U.S. Pat. No. 7,114,562 (incorporated herein by reference in its entirety) utilized as the LWD module 262 or part of the LWD tool suite 266. The LWD module 262 is provided with a probe 268 (which may be similar or identical to the probe 108 of FIG. 1) for establishing fluid communication with the formation 104 and drawing fluid 274 into the module, as indicated by the arrows 276. The probe 268 may be positioned in a stabilizer blade 270 of the LWD module 262 and extended therefrom to engage a wall 278 of the borehole 102. The stabilizer blade 270 may include one or more blades that are in contact with the borehole wall 278. Fluid 274 drawn into the LWD module 262 using the probe 268 may be measured to determine, for example, pretest and/or pressure parameters. The LWD module 262 may also be used to obtain and/or measure various characteristics of the fluid 274. Additionally, the LWD module 262 may be provided with devices, such as sample chambers, for collecting fluid samples for retrieval at the surface. Backup pistons 272 may also be provided to assist in applying force to push the LWD module 262 and/or probe 268 against the borehole wall 278.

Figure 3A:
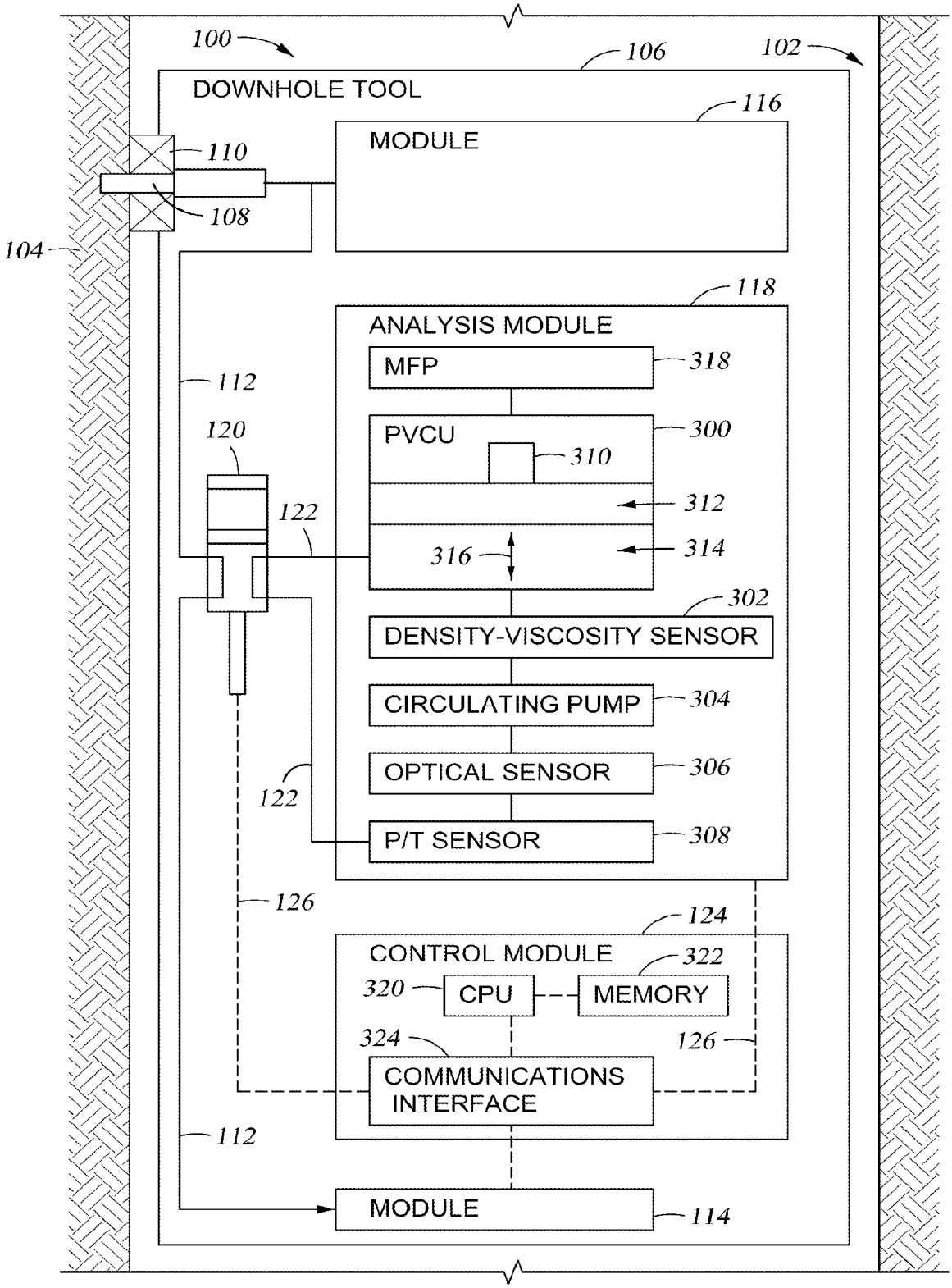
FIG. 3A is a schematic view of apparatus according to one or more aspects of the present disclosure.
Figure 3B:
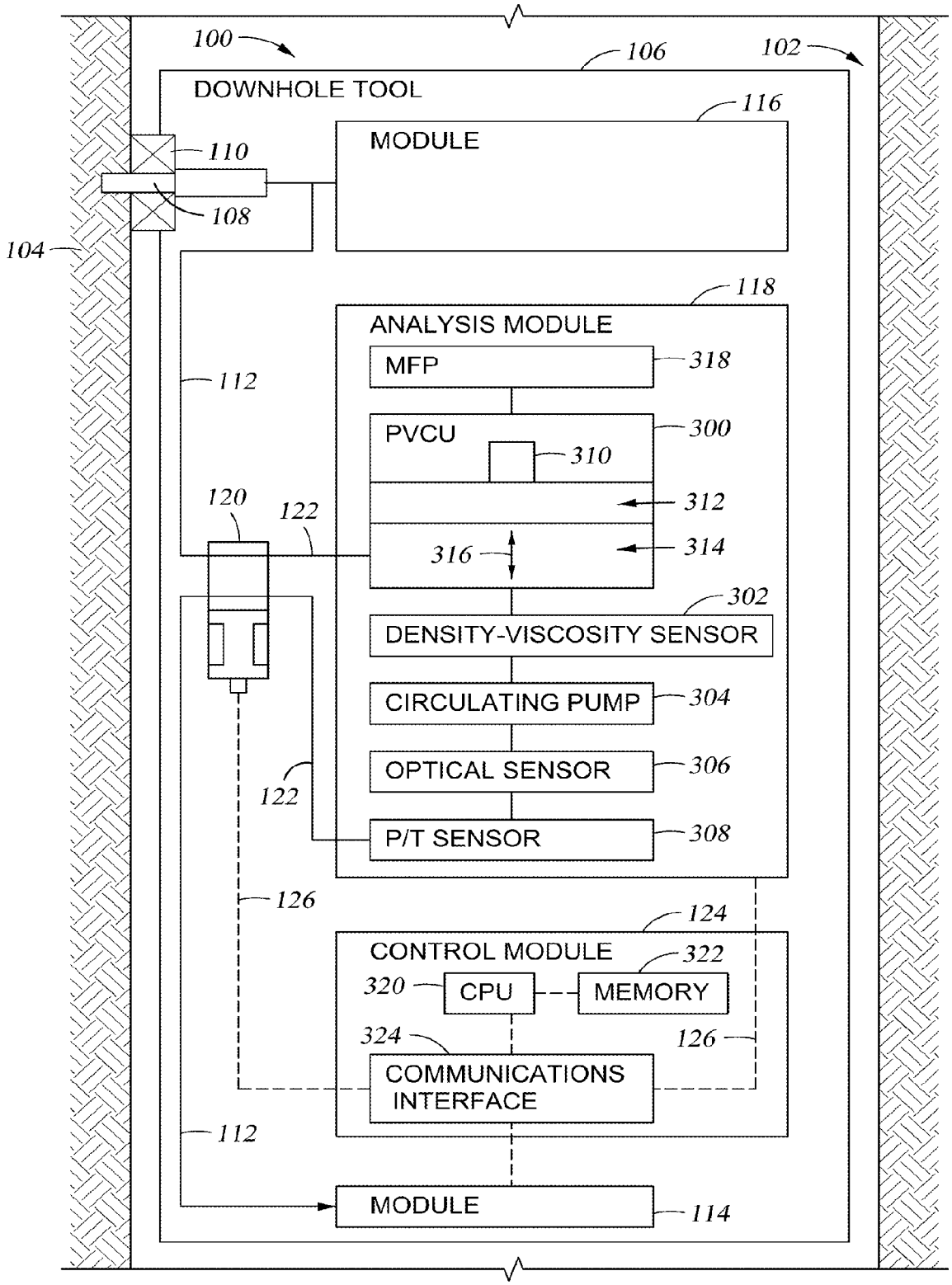
FIG. 3B is a schematic view of apparatus according to one or more aspects of the present disclosure.

FIGS. 3A and 3B are schematic views of an embodiment of the downhole tool 100 of FIG. 1 according to one or more aspects of the present disclosure. The valve 120, which may be a 4-by-2 valve (e.g., a four-port, two-position valve), is configured to control flow of the fluid sample from the main flowline 112 into the circulation flowline 122. By separating the analysis module 118 from the main flowline 112, various pressurization functions and/or other processes may be performed in an isolated manner. FIG. 3A shows the analysis module 118 isolated from the main flowline 112 and FIG. 3B shows the analysis module coupled to the main flowline 112.

The analysis module 118 may include a pressure volume control unit (PVCU) 300, a density-viscosity sensor 302, a circulating pump 304, an optical sensor 306, and/or a pressure/temperature (P/T) sensor 308. Each component 300, 302, 304, 306, and 308 may be in fluid communication with the next component via the circulation flowline 122. It is understood that the components 300, 302, 304, 306, and 308, circulation flowlines 122, and/or valves 120 may be arranged differently in other embodiments, and additional flowlines and/or valves may be present. The circulation flowline 122 may form a circulation flow loop.

The PVCU 300 may include a piston 312 having a shaft 310. The piston 312 may be positioned in a chamber 314 within which the body may move along a line indicated by arrow 316. A motive force producer (MFP) 318 (e.g., a motor) may be used to control movement of the piston 312 within the chamber 314 via the shaft 310. As the piston 312 moves back and forth along line 316, fluid in the circulation flow loop provided by the flowline 122 may be pressurized and depressurized. The PVCU 300 may be offset (e.g., not in the direct flow path of the circulation flow loop) yet remain in fluid communication with the circulation flow loop.

The density-viscosity sensor 302 is one example of a variety of density sensors that may be used in the analysis module 118. As is known, a density-viscosity sensor (i.e., a densitometer) may be used for measuring the fluid density of a downhole fluid sample. Such density-viscosity sensors are generally based on the principle of mechanically vibrating and resonating elements interacting with the fluid sample. Some density-viscosity sensor types use a resonating rod in contact with the fluid to probe the density of the surrounding fluid (e.g., a DV-rod type sensor), whereas other types use a sample flow tube filled with fluid to determine the density of the fluid. The density-viscosity sensor 302 may be used along the circulation flow loop formed by the flowline 122 for measuring the density of the fluid sample.

The circulating pump 304 may be used to agitate fluid within the circulation flow loop provided by the flowline 122. Such agitation may assist in obtaining accurate measurements as will be described later in greater detail.

The optical sensor 306 may be a single channel optical spectrometer that is used to detect the fluid phase change during depressurization. However, it is understood that many different types of optical detectors may be used.

The optical sensor 306 may select or be assigned one or more wavelength channels. A particular wavelength channel may be selected to improve sensitivity between the fluid density and corresponding optical measurements as the pressure changes. For example, a wavelength channel of 1600 nanometers (nm) may be used in applications dealing with medium and heavier oil. However, for gas condensate and light oil, there will typically be little optical absorption at this wavelength channel and as a result, the sensitivity of optical density to fluid density change would be significantly reduced. Accordingly, for gas condensate and light oil, different wavelength channels that show evidence of prominent absorption with hydrocarbon may be employed so that the sensitivity of optical density to fluid density change improves. For example, channel wavelengths of 1671 nm and 1725 nm may be used for methane and oil, respectively. Furthermore, the electronic absorption in the ultraviolet (UV)/visible/near infrared (NIR) wavelength region also shows sensitivity with the density (or concentration) of fluid. Therefore, color channels utilized by Live Fluid Analyzer (LFA) or InSitu Fluid Analyzer (IFA) technologies may be used with wavelength channels, for example, of 815 nm, 1070 nm, and 1290 nm. By choosing multiple wavelength channels, the signal-to-noise ratio may be improved by jointly inverting the fluid density and compressibility using multi-channel data.

The P/T sensor 308 may be any integrated sensor or separate sensors that provide pressure and temperature sensing capabilities. The P/T sensor 308 may be a silicon-on-insulator (SOI) sensor package that provides both pressure and temperature sensing functions.

The control module 124 may be configured for bidirectional communication with various modules and module components, depending on the particular configuration of the tool 100. For example, the control module 124 may communicate with modules which may in turn control their own components, or the control module 124 may control some or all of the components directly. The control module 124 may communicate with the valve 120, analysis module 118, and modules 114 and 116. The control module 124 may be specialized and integrated with the analysis module 118 and/or other modules and/or components.

The control module 124 may include a central processing unit (CPU) and/or other processor 320 coupled to a memory 322 in which are stored instructions for the acquisition and storage of the measurements, as well as instructions for other functions such as valve and piston control. Instructions for performing calculations based on the measurements may also be stored in the memory 322 for execution by the CPU 320. The CPU 320 may also be coupled to a communications interface 324 for wired and/or wireless communications via communication paths 126. The CPU 320, memory 322, and communications interface 324 may be combined into a single device or may be distributed in many different ways. For example, the CPU 320, memory 322, and communications interface 324 may be separate components placed in a housing forming the control module 124, may be separate components that are distributed throughout the tool 100 and/or on the surface, or may be contained in an integrated package such as an application specific integrated circuit (ASIC). Means for powering the tool 100, transferring information to the surface, and/or performing other functions unrelated to the analysis module 118 may also be incorporated in the control module 124.

The main flowline 112 may transport reservoir fluid into the 4-by-2 valve 120, which may control the flow of the fluid into the analysis module 118. When the 4-by-2 valve 120 is in the closed position (FIG. 3A), the reservoir fluid in the circulation flowline 122 is isolated from the main flowline 112. In contrast, when the 4-by-2 valve 120 is in the open position (FIG. 3B), the reservoir fluid is diverted through the circulation flowline 122 to displace the existing fluid in the circulation flow loop.

After pressurization by the PVCU 300, the fluid sample captured in the circulation flow loop formed by flowline 122 may undergo a constant composition expansion by depressurizing the fluid sample using the PVCU 300. During depressurization, the circulating pump 304 in the circulation flow loop may help to mix and agitate the fluid so that any phase changes (e.g., bubble formation) can be detected by all sensors. Measurements may be taken at various times during the pressurization and/or depressurization stages.

It is understood that many different agitation mechanisms (i.e., various forms of agitation and structures for accomplishing such agitation) may be used in place of or in addition to the agitation mechanism provided by the circulation of the fluid sample in the circulation flow loop. For example, some embodiments of an agitation mechanism may use a chamber (i.e., a pressure/volume/temperature cell) having a mixer/agitator disposed therein with the sensor 302 and/or sensor 306. In such an embodiment, the fluid sample may be agitated within the chamber rather than circulated through a circulation flow loop. In other embodiments, such a chamber may be integrated with a circulation flow loop. Accordingly, the terms "agitation" and "agitate" as used herein may refer to any process by which the fluid sample is circulated, mixed, or otherwise forced into motion.

The measurements acquired during the constant composition expansion may include pressure and/or temperature versus time from the P/T sensor 308, viscosity and/or density versus time from the density-viscosity sensor 302, sensor response versus time from the optical sensor 306, and/or depressurization rate and/or volume versus time, among others. Answer products that may be calculated from the preceding measurements may include density versus pressure, viscosity versus pressure, compressibility versus pressure, and phase-change pressure. Phase-change pressure may include one or more of asphaltene onset pressure, bubble point pressure, and dew point pressure, among others.

With respect to obtaining the compressibility of the fluid, the compressibility of the fluid sample may be obtained with the trapped fluid in a closed system during the isothermal depressurization (or pressurization) while maintaining the single-phase fluid above its phase-change pressure. Compressibility is defined in terms of pressure-volume (PV) relationship as follows:

$$c = -\frac{1}{v}\frac{dv}{dp} \quad \text{(Eq. 1)}$$

where c is the compressibility of fluid, v is the volume of the fluid, and p is the pressure exerted by the fluid.

To obtain accurate fluid compressibility estimates, one generally needs accurate PV data to perform the calculation described above with respect to Equation (1). However, obtaining accurate PV data is an intricate issue because the volume expansion during pressure change is not only accounted for by the expansion of the fluid itself, but also by the finite compliance of the material forming the circulation flow loop provided by flowline 122, as well as the expansion of any elastomer seals along the flowline. These extra volume expansions due to the finite compliance of material and elastomer expansion may be pressure dependent and typically may not be taken into account in the computation. This may lead to serious errors in estimating the fluid compressibility using the PV data.

To alleviate the problems of deriving the fluid compressibility from PV data, an alternative approach suggests deriving the fluid compressibility from the density measurements obtained by a density-viscosity sensor during depressurization. This approach entails a closed system during depressurization, such that the compressibility of fluid can be related to the density of fluid by:

$$c = -\frac{1}{\rho}\frac{d\rho}{dp} = \frac{d}{dp}\ln\rho \quad \text{(Eq. 2)}$$

where ρ is the density of fluid, which is a function of pressure. Equation (2) is the basis of deriving the compressibility from its density measurements.

In U.S. Pat. No. 6,474,152, the fluid compressibility is determined from the light absorption of fluid interrogated by an NIR optical spectrometer. For a particular wavelength, the light absorption measurement is called the optical density (OD) which is defined as:

$$OD = -\log_{10}\left(\frac{I}{I_0}\right) \quad \text{(Eq. 3)}$$

where I is the transmitted light intensity and $I_0$ is the source (or reference) light intensity at the same wavelength.

Based on the Beer-Lamberts law and experimental corroboration, the optical density measurement is linearly related to the density of fluid, i.e.:

$$OD = m\rho \quad \text{(Eq. 4)}$$

where m is an unknown constant. Therefore, the compressibility of fluid can be related to the optical density by the following equation:

$$c = \frac{1}{OD}\frac{dOD}{dp} \quad \text{(Eq. 5)}$$

In practice, the optical density (OD) defined in Equation (3) is often corrupted by imperfect calibration, spectrometer drift, electronic offset, optical scattering, and/or other factors. However, in the present disclosure, these unknown factors may be placed together into a constant offset term. When this offset term is included in Equation (4), the result is:

$$OD = m\rho + n \quad \text{(Eq. 6A)}$$

where m and n are two unknown constants. Equation (6A) linearly relates the captured fluid density to its optical density measurement. With these unknown factors placed together into the unknown offset term n, it is noted that the estimation of fluid compressibility based on Equation (5) is no longer valid. It is noted that Equation (6A) is valid only when the captured fluid remains in single phase. Equation (6A) can be rearranged as:

$$\rho = (OD - n)/m \quad \text{(Eq. 6B)}$$

Equation (6B) indicates that density can be computed from a measurement of optical density, as long as the constants m and n have been determined or are otherwise known.

However, with the density-viscosity sensor 302 and the optical sensor 306 in the circulating flow loop provided by the flowline 122, an in-situ calibration may be performed to determine the unknown constants m and n. More specifically, the density and optical measurements may be readily available at different flowline pressures by moving the piston 312 of the PVCU 300 back and forth (i.e., creating depressurization and pressurization). The least-squares estimate of m and n may then be obtained given multiple pairs of density and optical measurement recorded at different pressures.

Figure 4A:
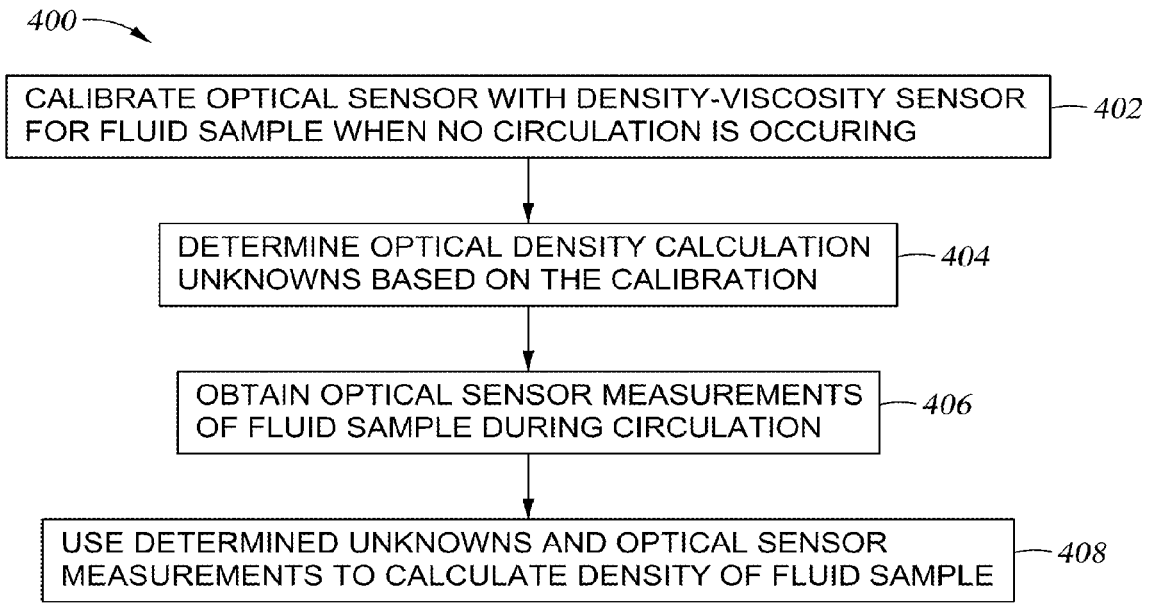
FIG. 4A is a flow chart diagram of at least a portion of a method according to one or more aspects of the present disclosure.

FIG. 4A is a flow-chart diagram of at least a portion of a method 400 according to one or more aspects of the present disclosure. The method 400 may be or comprise a process for determining a fluid density of a downhole fluid sample using the analysis module 118 shown in FIGS. 1, 3A and 3B.

In step 402, the optical sensor 306 may be calibrated with the density-viscosity sensor 302 with respect to the fluid sample. This calibration process, which will be discussed in greater detail in following examples, is performed when no circulation of the fluid sample is occurring in the circulating flow loop provided by the flowline 122. The calibration process occurs without circulation because vibration caused by the circulating pump 304 may negatively affect the readings obtained by the density-viscosity sensor 302. Accordingly, to obtain accurate density-viscosity sensor readings, the circulating pump 304 remains off during the calibration process. It is noted that the optical sensor 306 is unaffected by the vibration.

In step 404, unknowns needed for a later density calculation (e.g., unknowns m and n of Equations (6A) and (6B)) may be determined based on the calibration data. In step 406, measurements of the fluid sample are obtained by the optical sensor 306 while the fluid is being circulated in the circulating flow loop. In step 406, the optical sensor 306 is being used to obtain readings and the density-viscosity sensor 302 is not being used. Accordingly, the activation of the circulating pump 304 does not impact the readings of the optical sensor 306 obtained in this step. In step 408, the unknowns determined in step 404 and the optical sensor measurements obtained in step 406 may be used to calculate a density of the fluid sample (e.g., as shown in Equation (6B)).

It is noted that, even though the density-viscosity sensor 302 is capable of measuring the density of the fluid when no circulation is occurring, the methodology proposed herein may provide multiple benefits. In one example, the use of the optical sensor measurements enables density measurements to be obtained during circulation. In another example, the use of the optical sensor measurements enables a complementary density measurement to be derived even when the density-viscosity sensor 302 is usable (e.g., in cases where the fluid is a gas condensate, for which no circulation is needed).

Figure 4B:
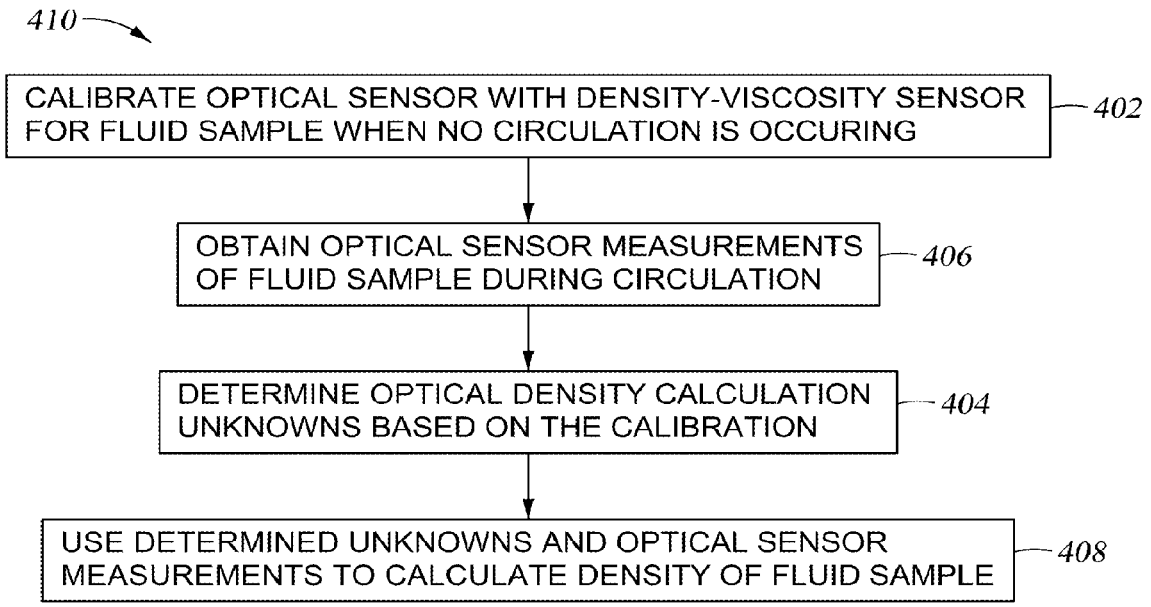
FIG. 4B is a flow chart diagram of at least a portion of a method according to one or more aspects of the present disclosure.

FIG. 4B is a flow-chart diagram of at least a portion of a method 410 according to one or more aspects of the present disclosure. The method 410 may be or comprise a process for determining a fluid density of a downhole fluid sample using the analysis module 118 shown in FIGS. 1, 3A and 3B. The method 410 is identical to the method 400 of FIG. 4A except that the steps are ordered differently. More specifically, in the method 410, measurement step 406 is performed after calibration step 402 and before step 404, rather than after step 404 as shown in FIG. 4A.

Figure 4C:
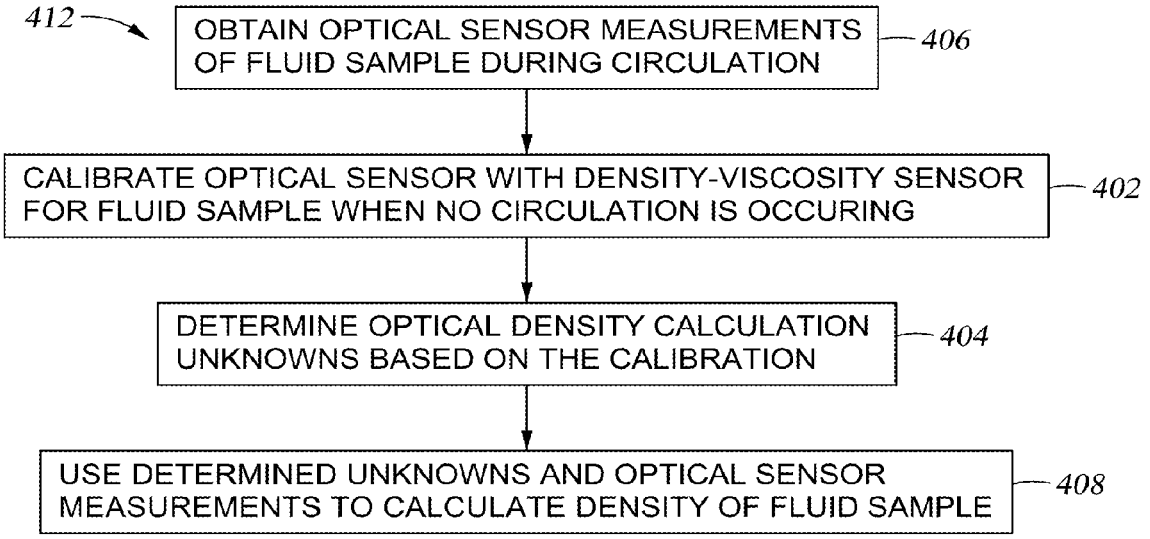
FIG. 4C is a flow chart diagram of at least a portion of a method according to one or more aspects of the present disclosure.

FIG. 4C is a flow-chart diagram of at least a portion of a method 412 according to one or more aspects of the present disclosure. The method 412 may be or comprise a process for determining a fluid density of a downhole fluid sample using the analysis module 118 shown in FIGS. 1, 3A and 3B. The method 412 is identical to the method 400 of FIG. 4A except that the steps are ordered differently. More specifically, in the method 412, measurement step 406 is performed before calibration step 402.

Figure 5B:
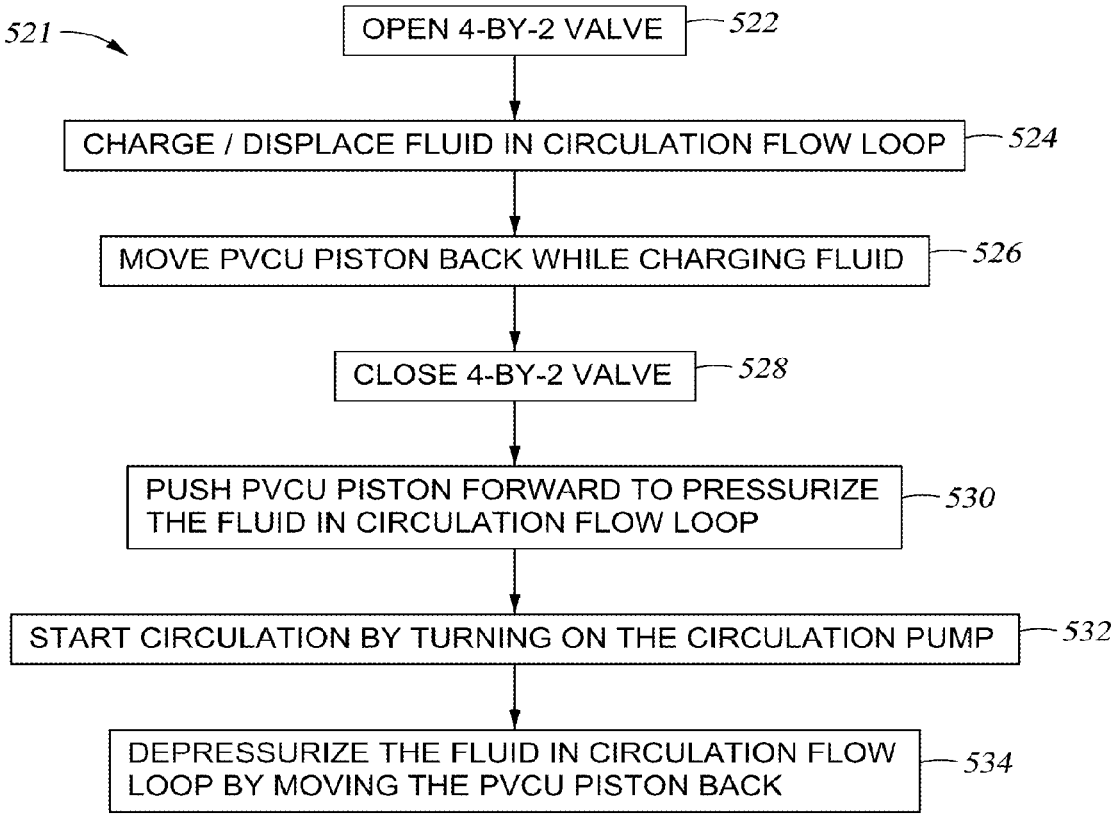
FIG. 5B is a flow chart diagram of at least a portion of a method according to one or more aspects of the present disclosure.
Figure 5A:
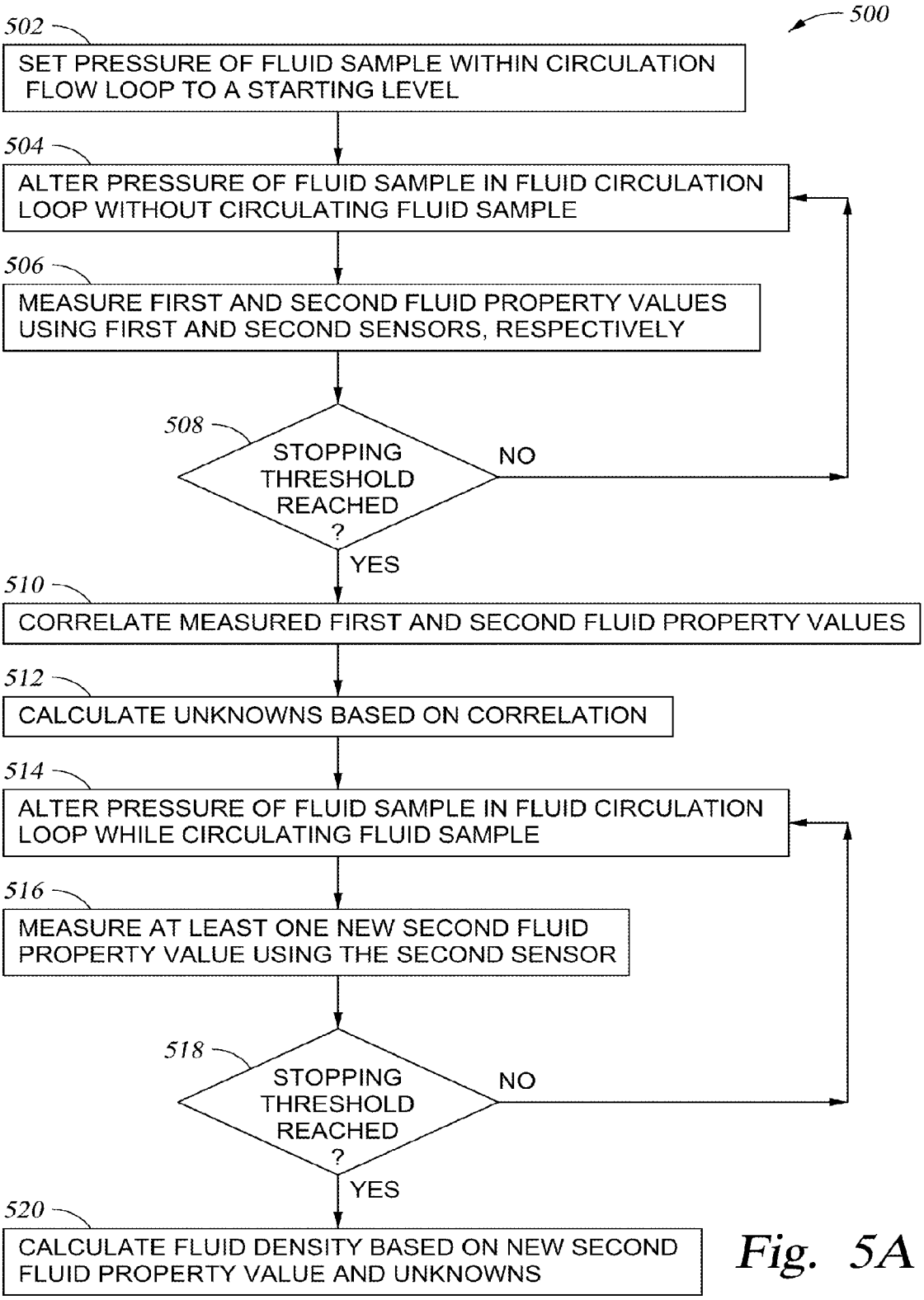
FIG. 5A is a flow chart diagram of at least a portion of a method according to one or more aspects of the present disclosure.

FIG. 5A is a flow-chart diagram of at least a portion of a method 500 according to one or more aspects of the present disclosure. The method 500 may be or comprise a process for determining at least one fluid characteristic of a downhole fluid sample using the analysis module 118 shown in FIGS. 1, 3A and 3B. In step 502, the fluid sample within the fluid flow loop provided by the flowline 122 is pressurized or depressurized to a starting pressure by the PVCU 300. This starting pressure may be identical for all fluid samples or may vary based on, for example, whether the fluid sample is a light fluid or a heavy fluid. It is understood that step 502, among other steps of the method 500, may be optional. For example, with respect to step 502, if the desired starting pressure is the pressure at which the fluid sample was captured, then no pressurization/depressurization may be needed.

In step 504, the pressure is altered (e.g., pressurization or depressurization occurs) by the PVCU 300. This alteration may continue until a stopping threshold is met. The stopping threshold may be a defined period of time, a number of measurements, a certain pressure level, and/or other desired criterion or set of criteria. During this time, the fluid sample is not being circulated in the circulating flow loop.

In step 506, a first fluid property value (e.g., fluid density) and a second fluid property value (e.g., optical absorption or transmittance) are measured using a first sensor (e.g., the density-viscosity sensor 302) and a second sensor (e.g., the optical sensor 306), respectively. It is noted that these measurements occur while the pressure is being altered.

In step 508, a determination is made as to whether the stopping threshold has been reached. If the stopping threshold has not been reached, the method 500 returns to step 504. If the stopping threshold has been reached, the method 500 continues to step 510, where the first fluid property values and the second fluid property values are correlated. In step 512, unknowns (e.g., unknowns m and n of Equations (6A) and (6B)) may be derived from the correlated first and second fluid property values.

In step 514, the pressure is again altered (e.g., pressurization or depressurization occurs) by the PVCU 300. This alteration may continue until a stopping threshold is met. The stopping threshold may be a defined period of time, a number of measurements, a certain pressure level, and/or other desired criterion or set of criteria. During this time, the fluid sample is being circulated in the circulating flow loop.

In step 516, one or more second fluid property values are measured using the second sensor. It is noted that these measurements occur while the pressure is being altered. In step 518, a determination is made as to whether the stopping threshold has been reached. If the stopping threshold has not been reached, the method 500 returns to step 514. If the stopping threshold has been reached, the method 500 continues to step 520, where the fluid density may be calculated (e.g., as shown in Equation (6B)) based on the second fluid property value(s) measured in step 516 and on the unknowns calculated in step 512.

Figure 6:
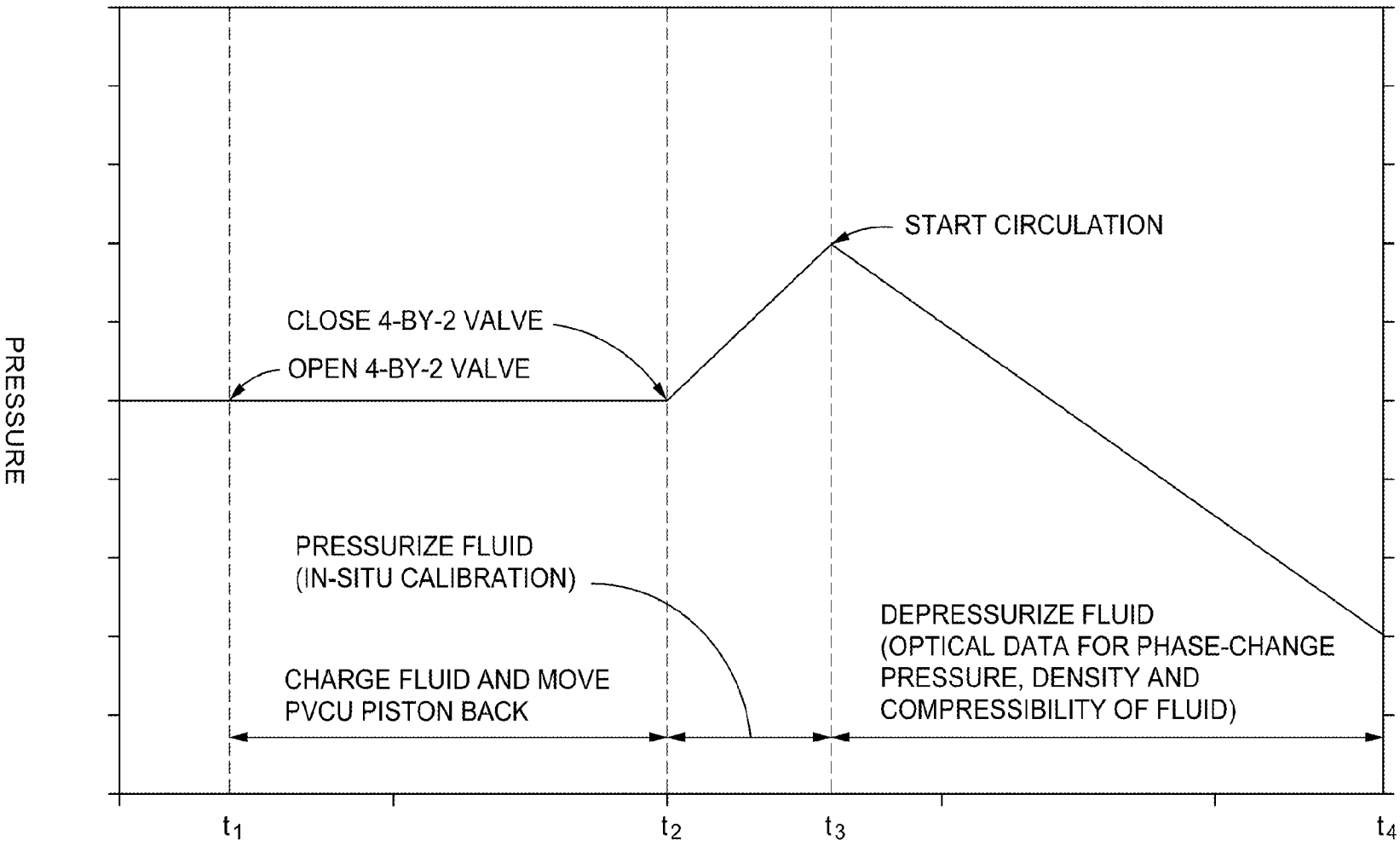
FIG. 6 is a schematic of a flowline pressure according to one or more aspects of the present disclosure.

FIG. 5B is a flow-chart diagram of at least a portion of a method 521 according to one or more aspects of the present disclosure. The method 521 may be or comprise a process for implementing in-situ calibration and measurement acquisition for the analysis module 118 shown in FIGS. 1, 3A and 3B. The method 521 may vary depending on the particular configuration of the analysis module 118. FIG. 6 illustrates a schematic of a flowline pressure profile for in-situ calibration and measurement acquisition according to the method 521 of FIG. 5B.

In step 522, the method 521 may begin by opening the 4-by-2 valve 120 (time $t_1$ of FIG. 6). This allows, in step 524, clean reservoir fluid from the main flowline 112 to displace the existing fluid in the circulation flow loop provided by the flowline 122 as illustrated in FIG. 3B. In step 526, while charging the reservoir fluid, the shaft 310 and piston 312 of the PVCU 300 may be pulled back to allow additional space in the chamber 314 to be filled with reservoir fluid. Steps 522, 524, and 526 may occur in a substantially simultaneous fashion or may occur in a staggered or separate manner. In step 528, when the circulation flow loop is filled with the reservoir fluid, the 4-by-2 valve 120 is closed (time $t_2$ of FIG. 6) to isolate the flow loop (FIG. 3A).

In step 530, the piston 312 may be moved forward (from time $t_2$ to $t_3$ of FIG. 6) to pressurize the fluid in the circulation flow loop. While pressuring the fluid in the flow loop, the density and optical measurements may be recorded using the density-viscosity sensor 302 and optical sensor 306 for in-situ calibration without turning on the circulating pump 304.

The circulating pump 304 is not active at this point in the method 521 because the density measurements from the density-viscosity sensor 302 become noisy and erratic with the circulating pump turned on. More specifically, as noted before, the phase behavior of the fluid may be determined with circulation during the depressurization cycle. However, noise may be introduced into the measurements of the density-viscosity sensor 302 by the circulating pump 304 due to the acoustic vibration generated by the circulating pump 304. Accordingly, the circulating pump 304 is inactive during data acquisition by the density-viscosity sensor 302 to ensure reliable data for the step of in-situ calibration.

The recorded density and optical measurements may then be used for the in-situ calibration to determine the two unknown constants m and n. Other than for in-situ calibration, this pressurization step 530 may also serve to raise the confining pressure to a level equal to or slightly higher than the reservoir pressure to obtain measurements starting at the reservoir pressure during depressurization.

In step 532, at the end of the pressurization step 530 (time $t_3$ of FIG. 6), the circulation pump may be turned on and may remain active for the succeeding depressurization step 534. In step 534, the piston 312 may be moved back to depressurize the fluid in the flow loop. At this time, optical measurements and corresponding pressures may be recorded for detecting the phase-change pressure and for deriving the fluid density and compressibility as a function of pressure using the methodology described previously. The depressurization step 534 ends at time $t_4$ of FIG. 6.

The times $t_1$, $t_2$, $t_3$ and $t_4$ may not represent an exact time when an identified action occurs. For example, a period of time may exist between closing the valve 120 at time $t_1$ and beginning pressurization by the PVCU 300, although both of these are represented by time $t_1$ in the provided example. In another example, an action may begin prior to the identified time, with pressurization by the PVCU 300 beginning prior to closing the valve 120 at time $t_2$. That is, the method 521 of FIG. 5B and the schematic of FIG. 6 are simply examples and may be modified while still achieving the desired in-situ calibration and measurement acquisition functions.

It is understood that the pressurization and depressurization described with respect to FIGS. 5B and 6 may be reversed, with depressurization occurring before pressurization. As long as the pressure is being altered and the measurements occur above the phase separation pressure for calibration purposes, the pressure change may occur in either an increasing or a decreasing manner.

The depressurization operation performed by the analysis module 118 may not be the same as a constant composition expansion (CCE) performed in a surface laboratory. That is, the process used by the analysis module 118 may use a continuous depressurization with circulation, whereas the surface laboratory performs a step-wise depressurization and waits for the equilibrium state (by agitating the fluid with a mixer) at each discrete pressure step.

As a more specific example of laboratory procedures, a surface laboratory generally uses a known volume of fluid sample that is depressurized from a pressure greater or equal to the reservoir pressure at the reservoir temperature. At each step that the pressure is reduced, the fluid sample is allowed to come to equilibrium via agitation with a mixer. Once the sample has come to equilibrium, the pressure and volume are recorded. This depressurization process repeats at steps of 500 or 1000 pounds per square inch (psi) until the gas is separated from the fluid sample. After the gas is separated from the fluid, the depressurization step is reduced to a smaller increment such as 100 psi. The entire process may take a few hours to complete for a regular oil sample and may take a few days for heavy oil. The bubble point is determined as the break point between the single phase and two-phase region based on the recorded pressure and volume data or by the visual observation of formation of bubbles in the fluid. Accordingly, this laboratory process differs from the continuous depressurization with circulation process used by the analysis module 118.

The optical sensor's response (i.e., light transmittance) increases as the pressure decreases. This is the density effect because, as the density (or concentration) of fluid decreases with decreasing pressure, the absorption of transmitted light decreases and as a result, the light transmittance would increase. At the phase-change pressure, the response plunges quickly because the gas bubbles start coming out of the fluid.

As described previously, the density and optical measurements may be readily available at different flowline pressures by moving the piston 312 of the PVCU 300 back and forth (i.e., creating depressurization and pressurization). The least-squares estimate of m and n can then be obtained given multiple pairs of density and optical measurement recorded at different pressures. For example, using a crossplot of density-viscosity sensor density values versus optical sensor OD values acquired during the in-situ calibration and determining a line as the best least squares fit to the data, m and n in Equation (6B) may be determined as the slope and intercept of the line. With m and n known, values obtained by the optical sensor 306 during depressurization may be used with Equation (6B) to produce the corresponding fluid density measurements during depressurization.

Many of the previous embodiments are directed to a fluid that is a liquid, although such embodiments may also be applicable to a fluid that is a gas condensate. As is known, if the pressure of a gas condensate is reduced, droplets of liquid will form when the pressure reaches the dew point. With a gas condensate, the droplets are readily detectable by optical sensors without needing circulation to move them through a sensor's detection area. Accordingly, the density-viscosity sensor 302 may be used to measure the density because there is no vibration from the circulating pump 304 to introduce noise into the measurements. However, the previously described steps of calibration and measuring with the optical sensor 306 may be used to provide redundant measurements.

It will be appreciated by those skilled in the art having the benefit of this disclosure that variations may be made to the described embodiments for the system and method for obtaining fluid density from optical downhole measurements. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

The present disclosure introduces a method comprising performing a calibration process that correlates first optical sensor measurements and density sensor measurements of a fluid sample in a downhole tool at a plurality of pressures, wherein the calibration process is performed while the fluid sample is not being agitated; determining at least one unknown value of a density calculation based on the correlated optical sensor measurements and density sensor measurements obtained during the calibration process; obtaining a second optical sensor measurement of the fluid sample while the fluid sample is being agitated; and calculating a density of the fluid sample using the density calculation, wherein the density calculation is based on the second optical sensor measurement and the at least one unknown value. The step of obtaining the second optical sensor measurement may occur before the step of performing the calibration process. The step of determining at least one unknown value may occur after the step of obtaining the second optical sensor measurement. The downhole tool may include a fluid circulation loop and the fluid sample may be agitated by circulating the fluid sample in the fluid circulation loop. Performing the calibration process may include altering a pressure of the fluid sample until a stopping threshold is reached; and obtaining the optical sensor measurements and density sensor measurements using an optical sensor and a density-viscosity sensor, respectively, while the pressure of the fluid sample is being altered. Altering the pressure may include increasing the pressure. Altering the pressure may include decreasing the pressure. The method may further comprise opening a valve coupling a first fluid flowline and a second fluid flowline in the downhole tool to permit the fluid sample to move from the first fluid flowline into the second fluid flowline; closing the valve to isolate the second fluid flowline from the first fluid flowline; moving a piston in a chamber in fluid communication with the second fluid flowline to alter the pressure of the fluid sample contained in the isolated second fluid flowline until the stopping threshold is reached; and engaging a circulation pump in fluid communication with the second fluid flowline to agitate the fluid sample only after performing the calibration process. The method may further comprise moving the piston in the chamber to alter the pressure of the fluid sample contained in the isolated second fluid flowline while the circulation pump is engaged. The method may further comprise calculating a compressibility of the fluid sample based on the calculated density of the fluid sample.

The present disclosure also introduces a method comprising altering a pressure of a fluid sample in a downhole tool for a first period of time until a first stopping threshold is reached; measuring a plurality of first fluid property values and a plurality of second fluid property values of the fluid sample using first and second sensors, respectively, while the pressure of the fluid sample is being altered and while the fluid sample is not being agitated; and correlating the plurality of first and second fluid property values. The method may further comprise calculating at least one unknown value based on the correlated plurality of first and second fluid property values. The method may further comprise altering the pressure of the fluid sample for a second period of time until a second stopping threshold is reached; agitating the fluid sample while the pressure is being altered for the second period of time; obtaining at least one new second fluid property value of the fluid sample using the second sensor while the fluid sample is being agitated; and calculating a density of the fluid sample based on the at least one new second fluid property value and the at least one unknown value. Calculating the at least one unknown value may include identifying a least-squares estimate of unknown values m and n. Calculating the density of the fluid sample may be based on using the new second fluid property value as an optical density (OD) in the equation $\rho=(OD-n)/m$, where $\rho$ is the density of the fluid sample. Agitating the fluid sample may include circulating the fluid sample in a circulation flow loop in the downhole tool. The fluid may be a gas condensate, and the method may further comprise obtaining a plurality of new second fluid property values of the fluid sample using the second sensor while the fluid sample is not being agitated; and calculating a density of the fluid sample based on the plurality of new second optical values and the at least one unknown value. The fluid may be a liquid. Altering the pressure of the fluid sample may comprise decreasing the pressure. Altering the pressure of the fluid sample may comprise increasing the pressure. Measuring the plurality of second fluid property values may comprise measuring at least one of an optical absorption and a transmittance of the fluid sample. Measuring the plurality of first fluid property values may comprise measuring a fluid density of the fluid sample.

The present disclosure also introduces an apparatus comprising: a main fluid flowline positioned within a housing; a circulating fluid flowline positioned within the housing; a multi-port valve positioned within the housing and coupling the main fluid flowline and the circulating fluid flowline, wherein the multi-port valve is configured to move between a first position that places the main fluid flowline and the circulating fluid flowline in fluid communication, and a second position that isolates the circulating fluid flowline from the main fluid flowline; a downhole analysis module positioned within the housing and having a pressure and volume control unit (PVCU) controlled by a motive force producer, a density-viscosity sensor, a circulating pump, an optical sensor, and a pressure/temperature sensor, wherein each of the PVCU, density-viscosity sensor, circulating pump, optical sensor, and pressure/temperature sensor are coupled to the circulating fluid flowline; and a control module positioned within the housing and having a communications interface coupled to the multi-port valve and the analysis module, a processor coupled to the communications interface, and a memory coupled to the processor, wherein the memory comprises a plurality of instructions executable by the processor, the instructions including instructions for: manipulating the multi-port valve to the first position to allow a fluid sample to move from the main fluid flowline to the circulating fluid flowline and then manipulating the valve to the second position to isolate the circulating fluid flowline from the main fluid flowline; setting a pressure of a fluid sample in the isolated fluid circulation loop to a starting pressure using the PVCU; altering the pressure of the fluid sample in the fluid circulation loop for a first time period until a stopping threshold is reached using the PVCU; measuring a plurality of density-viscosity values and a plurality of optical values of the fluid sample using the density-viscosity sensor and the optical sensor, respectively, while the pressure of the fluid sample is being altered and while the circulating pump is not activated; and correlating the plurality of density-viscosity values and the optical values to calibrate the density-viscosity sensor and the optical sensor. The apparatus may further comprise instructions for: altering the pressure of the fluid sample in the fluid circulation loop for a second time period until a stopping threshold is reached using the PVCU; activating the circulating pump to agitate the fluid sample during the second time period; and measuring a second plurality of optical values of the fluid sample using the optical sensor while the circulating pump is activated. The apparatus may further comprise instructions for calculating a fluid density of the fluid sample based on the correlation of the plurality of density-viscosity values and the optical values and based on the second plurality of optical values. The apparatus may further comprise instructions for assigning one or more wavelength channels to the optical sensor.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a main fluid flowline positioned within a housing;

a circulating fluid flowline positioned within the housing;

a multi-port valve positioned within the housing and coupling the main fluid flowline and the circulating fluid flowline, wherein the multi-port valve is configured to move between a first position that places the main fluid flowline and the circulating fluid flowline in fluid communication, and a second position that isolates the circulating fluid flowline from the main fluid flowline;

a downhole analysis module positioned within the housing and having a pressure and volume control unit (PVCU) controlled by a motive force producer, a density-viscosity sensor, a circulating pump, an optical sensor, and a pressure/temperature sensor, wherein each of the PVCU, density-viscosity sensor, circulating pump, optical sensor, and pressure/temperature sensor are coupled to the circulating fluid flowline; and a control module positioned within the housing and having a communications interface coupled to the multi-port valve and the analysis module, a processor coupled to the communications interface, and a memory coupled to the processor, wherein the memory comprises a plurality of instructions executable by the processor, the instructions including instructions for:

manipulating the multi-port valve to the first position to allow a fluid sample to move from the main fluid flowline to the circulating fluid flowline and then manipulating the valve to the second position to isolate the circulating fluid flowline from the main fluid flowline;

setting a pressure of a fluid sample in the isolated fluid circulation loop to a starting pressure using the PVCU;

altering the pressure of the fluid sample in the fluid circulation loop for a first time period until a first stopping threshold is reached using the PVCU;

measuring a plurality of density-viscosity values and a plurality of optical values of the fluid sample using the density-viscosity sensor and the optical sensor, respectively, while the pressure of the fluid sample is being altered and while the circulating pump is not activated; and correlating the plurality of density-viscosity values and the optical values.

2. The apparatus of claim 1 further comprising instructions for:

altering the pressure of the fluid sample in the fluid circulation loop for a second time period until a second stopping threshold is reached using the PVCU;

activating the circulating pump to agitate the fluid sample during the second time period; and measuring a second plurality of optical values of the fluid sample using the optical sensor while the circulating pump is activated.

3. The apparatus of claim 2 further comprising instructions for calculating a fluid density of the fluid sample based on the correlation of the plurality of density-viscosity values and the optical values and based on the second plurality of optical values.

4. The apparatus of claim 1 further comprising instructions for assigning one or more wavelength channels to the optical sensor.

* * * * *